US010424865B2

(12) United States Patent
Lam

(10) Patent No.: US 10,424,865 B2
(45) Date of Patent: Sep. 24, 2019

(54) SPLICED ELECTRICAL CONNECTOR

(71) Applicant: Hok Man Lam, Hong Kong (HK)

(72) Inventor: Hok Man Lam, Hong Kong (HK)

( * ) Notice: Subject to any disclaimer, the term of this patent is extended or adjusted under 35 U.S.C. 154(b) by 0 days.

(21) Appl. No.: 16/153,826

(22) Filed: Oct. 8, 2018

(65) Prior Publication Data

US 2019/0044273 A1 Feb. 7, 2019

Related U.S. Application Data

(63) Continuation of application No. PCT/CN2017/081863, filed on Apr. 25, 2017.

(30) Foreign Application Priority Data

Apr. 27, 2016 (HK) ..... 16104820

(51) Int. Cl.

| | |
|---|---|
| ***H01R 13/62*** | (2006.01) |
| ***H01R 13/514*** | (2006.01) |
| ***H01R 13/11*** | (2006.01) |
| ***H01R 24/58*** | (2011.01) |
| ***H01R 31/00*** | (2006.01) |
| ***F21S 4/22*** | (2016.01) |
| ***H01R 25/00*** | (2006.01) |
| *F21Y 115/10* | (2016.01) |

(52) U.S. Cl.

CPC ..... *H01R 13/514* (2013.01); *F21S 4/22* (2016.01); *H01R 13/111* (2013.01); *H01R 13/6205* (2013.01); *H01R 24/58* (2013.01); *H01R 25/006* (2013.01); *H01R 31/005* (2013.01); *F21Y 2115/10* (2016.08)

(58) Field of Classification Search

CPC ..... H01R 13/6205

See application file for complete search history.

(56) References Cited

U.S. PATENT DOCUMENTS 3,651,444 A * 3/1972 Desso ..... H01R 13/4538 439/141

3,654,586 A * 4/1972 Winkler ..... H01R 13/64 439/295

(Continued)

FOREIGN PATENT DOCUMENTS

| | | |
|---|---|---|
| CN | 103887631 A | 6/2014 |
| CN | 105356125 A | 2/2016 |
| CN | 205141262 U | 4/2016 |

OTHER PUBLICATIONS

Internation Search Report of PCT/CN2017/081863, dated Jul. 28, 2017.

*Primary Examiner* — Tho D Ta

(74) *Attorney, Agent, or Firm* — W&K IP

(57) ABSTRACT

A splice connector, comprising a connector body and a connecting component connected with the connector body by plug joint. The connector body comprises a shell, a magnetic component arranged in an inside of the shell and configured for magnetic attraction, and a conductive component embedded on the shell. The shell comprises an abutting surface, two end surfaces vertical to the abutting surface, a positioning component arranged on the abutting surface and for positioning while abutting with other connectors, a first jack and a second jack respectively opened on the two end surfaces. The connecting component is electrically connected to the conductive component via the first jack and second jack.

12 Claims, 7 Drawing Sheets

(56) References Cited

U.S. PATENT DOCUMENTS

| | | | | |
|---|---|---|---|---|
| 4,969,834 | A * | 11/1990 | Johnson | H01R 13/6691 320/105 |
| 6,565,363 | B2 * | 5/2003 | Downing | H01R 13/6205 439/38 |
| 9,083,110 | B2 * | 7/2015 | McClelland | H01R 13/6205 |
| 9,088,114 | B2 * | 7/2015 | Chen | H01R 13/717 |
| 9,153,986 | B1 * | 10/2015 | Herr | H02J 7/0044 |
| 2001/0031565 | A1 * | 10/2001 | Sakiyama | H01T 1/06 439/38 |
| 2015/0364860 | A1 * | 12/2015 | Cheng | H01R 13/60 439/40 |

* cited by examiner

SPLICED ELECTRICAL CONNECTOR

CROSS-REFERENCE TO RELATED APPLICATIONS

This application is a continuation of International Patent Application No. PCT/CN2017/081863 with a filing date of Apr. 25, 2017, designating the United States, now pending, and further claims priority to Hong Kong Patent Application No. 16104820.0 with a filing date of Apr. 27, 2016. The content of the aforementioned applications, including any intervening amendments thereto, are incorporated herein by reference.

TECHNICAL FIELD

The invention discloses an electrical connector, and specifically relates to a splice electrical connector.

BACKGROUND ART

At present, with the rapid development of electronics technology, it is often necessary to achieve the electric signal transmission & transferring between two or among two above electronic equipment. Electric signal transmission & transferring are implemented via an electrical connector. The electrical connector refers to the connecting element among electronic equipment, and it is used for connecting equipment and achieving the electric signal transmission &transferring among equipment. A plug joint way is taken in the traditional electrical connector, and such kind of connection way causes the drop of connection efficiency. Meanwhile, the traditional plug joint way cannot share the electric signal of electronic equipment to other multiple equipment, therefore, the application is comparatively limited.

Moreover, due to single structure, the traditional connector cannot be personally designed and changed according to customer's demands, and because of its single function, the traditional connector is deficiency in aesthetic feeling.

SUMMARY OF THE INVENTION

The purpose of the invention is to provide a splice electrical connector to solve the above problem.

The above purpose of the invention is achieved via the following technical solutions:

A splice connector, comprising a connector body and a connecting component connected with the connector body by plug joint. The connector body comprises a shell, a magnetic component arranged in an inside of the shell and configured for magnetic attraction, and a conductive component embedded on the shell. The shell comprises an abutting surface, two end surfaces vertical to the abutting surface, a positioning component arranged on the abutting surface and for positioning while abutting with other connectors, a first jack and a second jack respectively opened on the two end surfaces. The connecting component is electrically connected to the conductive component via the first jack and second jack.

Furthermore, the positioning component comprises a positioning hole and a positioning post, the size of the positioning hole is the same as the positioning post.

Furthermore, the magnetic component is in the shape of spherical or columnar.

Furthermore, a connecting hole is opened at the abutting surface on a position right above the magnetic component, and a top portion of the magnetic component is exposed via the connecting hole.

Furthermore, the conductive component comprises a first electrode sheet group and a second electrode sheet group, the first electrode sheet group and second electrode sheet group are electrically connected with each other.

Furthermore, the first electrode sheet group comprises a first negative electrode sheet, first control electrode sheet and a first positive electrode sheet which are arranged on the connector body in lengthwise direction successively, the second electrode sheet group comprises a second positive electrode sheet, a second control electrode sheet and a second negative electrode sheet which are arranged on the connector body in lengthwise direction successively. The first positive electrode sheet is electrically connected to the second positive electrode sheet; the first negative electrode sheet is electrically connected to the second negative electrode sheet; and the first control electrode sheet is electrically connected to the second control electrode sheet.

Furthermore, the connecting component comprises a first connecting part and second connecting part, the first connecting part is plugged into the first jack, contacting the first electrode sheet group and establishing electrical connection; and the second connecting part is plugged into the second jack, contacting the second electrode sheet group.

Furthermore, the first connecting part comprises a first positive electrode component, first negative electrode component and a first control component. The first positive electrode component contacts the first positive electrode sheet and establishes electrical connection with the first positive electrode sheet, the first negative electrode component contacts the first negative electrode sheet and establishes electrical connection with the first negative electrode sheet, the first control component contacts the first control electrode sheet and establishes electrical connection with the first control electrode sheet. The second connecting part comprises a second positive electrode component, a second negative electrode component and a second control component. The second positive electrode component contacts the second positive electrode sheet and establishes electrical connection with the second positive electrode sheet, the second negative electrode component contacts the second negative electrode sheet and establishes electrical connection with the second negative electrode sheet, the second control component contacts the second control electrode sheet and establishes electrical connection with the second control electrode sheet.

Furthermore, the connecting component comprises a first end, second end and a connecting component body. The connecting component body is bent into an angle, and the angle is an interior angle of a regular polygon.

Furthermore, the angle is 60°, 90° or 120°.

Furthermore, the connecting component body is made of hard rubber, rigid plastic or metal materials.

Furthermore, a LED light source is embedded on an outer surface of the connector; and the LED flashes when a current flows through the connector.

Furthermore, the connecting component comprises a first end, a second end and a connecting component body. The connecting component is made of a bendable flexible material so that the connecting component is capable of being bent into any angle.

Beneficial effects of the invention are as follows: the splice connector provided by the invention comprises a connector body and a connecting component connected to the connector body by plug joint. The connection of two connector bodies can be rapidly implemented via the attraction of the two magnetic components as well as the coordination between the positioning post and positioning hole.

Meanwhile, the multiple connector bodies and the connecting component can be spliced into different geometrical shapes, capable of being used as connectors and ornaments via setting the connecting component into different angles and length.

BRIEF DESCRIPTION OF THE DRAWINGS

The drawings are provided to further understand the invention and constitute a portion of the specification. It is used for explaining the invention together with the following embodiments, but not limiting the invention.

Wherein.

Figure 1:
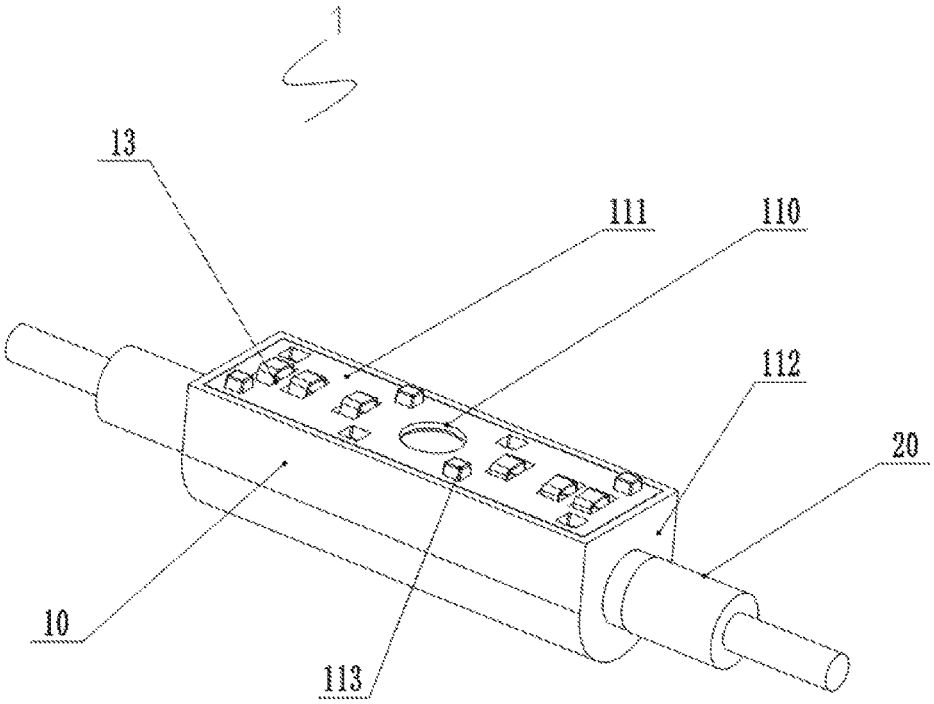
FIG. 1 is a structure diagram of the connector body in the splice connector provided by the embodiment I of the invention.

Electrical connector 1, connector body 10, connecting component 20, shell 11, magnetic component 12, conductive component 13, abutting surface 111, end surface 112, positioning component 113, first jack 114, second jack 115, connecting hole 110, positioning hole 1131, positioning post 1132, first electrode sheet group 131, second electrode sheet group 132, first negative electrode sheet 1311, first control electrode sheet 1312, first positive electrode sheet 1313, second positive electrode sheet 1323, second control electrode sheet 1322, second negative electrode sheet 1321, first connecting part 21, second connecting part 22, first positive electrode component 211, first negative electrode component 212, first control component 213, second positive electrode component 221, second negative electrode component 222, second control component 223, first end 201, second end 202, connecting component body 203.

DETAILED DESCRIPTION OF THE INVENTION

Combined with the drawings of the embodiments in this invention, the technical solutions in the embodiments of the invention will be clearly and integrally described below. Obviously, the described embodiments are partial embodiments of the invention only. Based on the embodiments of the invention, all other embodiments obtained by the general technical staff in this field without making creative labor belong to the protective scope of the invention.

Embodiment I

Figure 2:
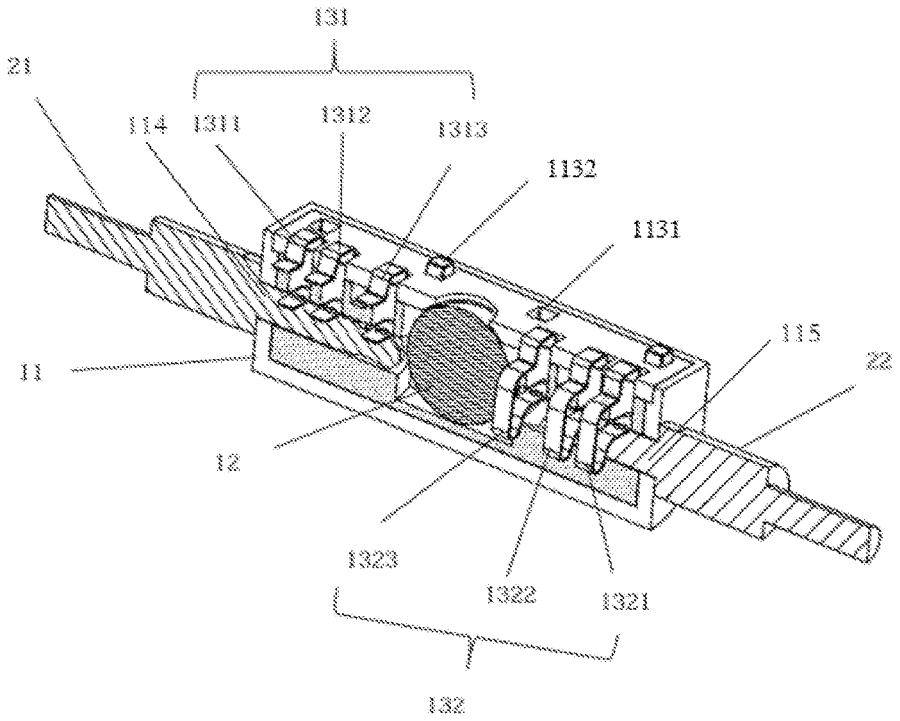
FIG. 2 is a cross-sectional view of FIG. 1 in A-A direction.
Figure 3:
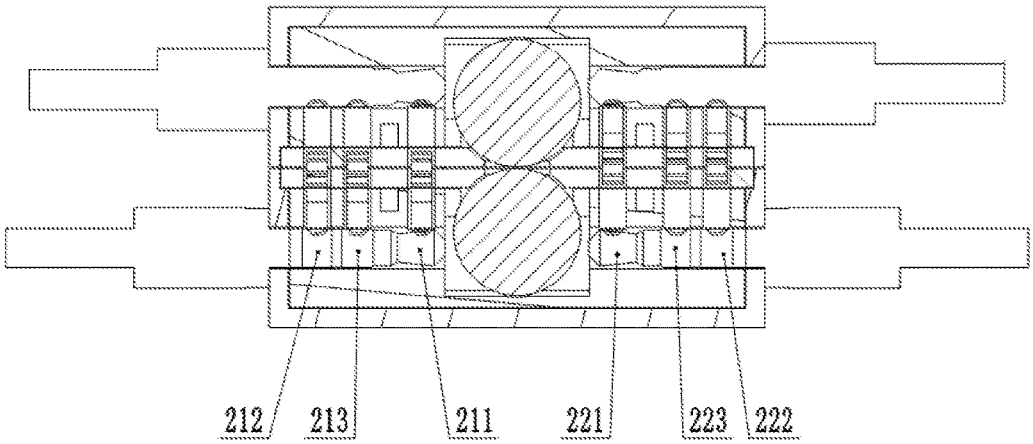
FIG. 3 is a sectional structure diagram of the two splice connectors after splicing as shown in the FIG. 1.

Please refer to FIG. 1, FIG. 2 and FIG. 3, the splice connector 1 provided by the embodiment I of the invention comprises a connector body 10 and a connecting component 20 connected with the connector body 10 by plug joint.

The connector body 10 comprises a shell 11, a magnetic component 12 arranged in an inside of the shell 11 and configured for magnetic attraction, and a conductive component 13 embedded on the shell.

The shell 11 comprises an abutting surface 111, two end surfaces 112 vertical to the abutting surface 111, a positioning component 113 arranged on the abutting surface 111 and for positioning while abutting with other connectors, a first jack 114 and second jack 115 respectively opened on the two end surfaces 112. The connecting component 20 is electrically connected with the conductive component 13 via the first jack 114 and second jack 115.

The abutting surface 111 can be a rectangle, square, rhombus and other geometrical-symmetry graph, preferably, it is a rectangle in the embodiment. In this embodiment, a connecting hole 110 is opened at the abutting surface 111 on a position right above the magnetic component 12, and a top portion of the magnetic component 12 is exposed via the connecting hole 110, and the diameter of the magnetic component 12 is greater than the diameter of the connecting hole 110. The positioning component 113 comprises a positioning hole 1131 and a positioning post 1132, the size of the positioning hole 1131 is the same as the positioning post 1132.

When the two connectors are butted, the first positioning post 1132*a* of the first connector 1*a* can be fully embedded into the second positioning hole 1131*b* of the second connector 1*b*, the second positioning post 1132*b* of the second connector 1*b* can be embedded into the first positioning hole 1131*a* of the first connector 1*a*. Through this way, the abutting surface 111*a* of the first connector 1*a* can fully fit with the abutting surface 111*b* of the second connector 1*b*, so as to further achieve the electric connection of the conductive components 13 between the two connectors.

The magnetic component 12 is in the shape of spherical or columnar, preferably, spherical. The conductive component 13 comprises a first electrode sheet group 131 and a second electrode sheet group 132, top portions of the first electrode sheet group 131 and second electrode sheet group 132 protrude the abutting surface 111, bottom parts of the first electrode sheet group 131 and second electrode sheet group 132 respectively stretch into the first jack 114 and the second jack 115. The first electrode sheet group 131 comprises a first negative electrode sheet 1311, a first control electrode sheet 1312 and a first positive electrode sheet 1313 which are arranged on the connector body 10 in lengthwise direction successively. The second electrode sheet group 132 comprises a second positive electrode sheet 1312, a second control electrode sheet 1322 and a second negative electrode sheet 1321 which are arranged on the connector body 10 in lengthwise direction successively. The second electrode sheet group 132 and the first electrode sheet group are set symmetrically. The first positive electrode sheet 1313 is electrically connected to the second positive electrode sheet 1323; the first negative electrode sheet 1311 is electrically connected to the second negative electrode sheet 1321; and the first control electrode sheet 1312 is electrically connected to the second control electrode sheet 1322.

The connecting component 20 comprises a first connecting part 21 and a second connecting part 22. The first connecting part 21 comprises a first positive electrode component 211, first negative electrode component 212 and a first control component 213. The first connecting part 21 is plugged into the first jack 114, contacting the first electrode sheet group 131 and establishing electrical connection. The first positive electrode component 211 contacts the first positive electrode sheet 1313 and establishes electrical connection with the first positive electrode sheet 1313, the first negative electrode component 212 contacts the first negative electrode sheet 1311 and establishes electrical connection with the first negative electrode sheet 1311, the first control component 213 contacts the first control electrode sheet 1312 and establishes electrical connection with the first control electrode sheet 1312. Similarly, the second connecting part 22 comprises a second positive electrode component 221, a second negative electrode component 222 and a second control component 223. The second connecting part 22 is plugged into the second jack 115 and contacts the second electrode sheet group 132 to achieve the contact and electric connection between the second positive electrode component 221 and the second positive electrode sheet 1323. The second negative electrode component 222 contacts the second negative electrode sheet 1321 and establishes electrical connection with the second negative electrode sheet 1321, the second control component 223 contacts the second control electrode sheet 1322 and establishes electrical connection with the second control electrode sheet 1322.

In an embodiment of the invention, a LED light source (not as shown in the figure) is embedded in the connector 1, and the LED flashes when a current flows through the connector 1.

Embodiment II

Figure 4:
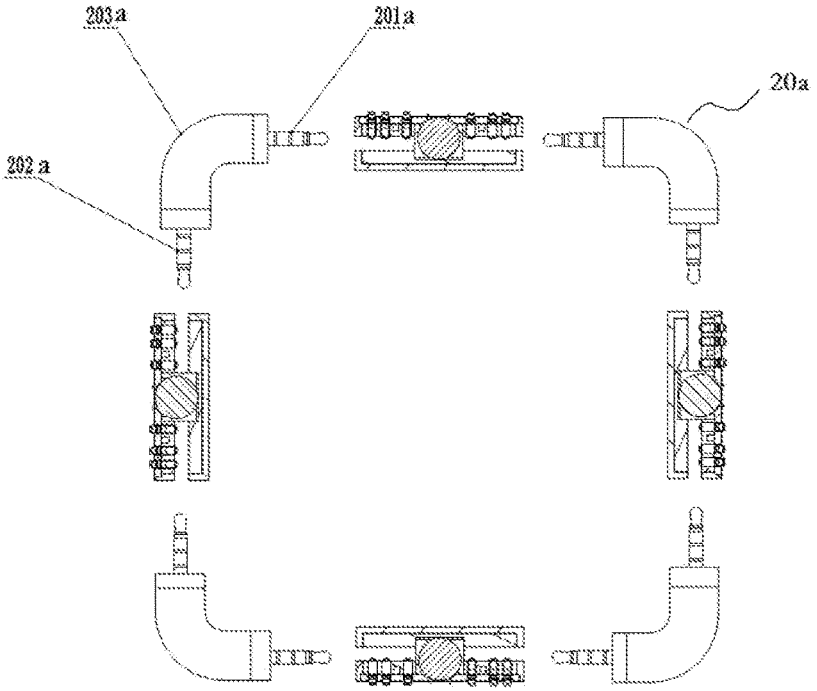
FIG. 4 is a splice structure diagram of the splice connector provided by the embodiment II of the invention.

Please refer to FIG. 4, and FIG. 4 is the second connecting part structure diagram of the splice connector provided by the embodiment II of the invention. The connector in the embodiment II is the same as the connector 1 basically in the embodiment I, and the major difference lies in that: in the embodiment II, the connecting component 20*a* comprises a first end 201*a*, second end 202*a* and a connecting component body 203*a*. The first end 201*a* is arranged same as the second end 202*a*, and the both two are set same as the first connecting part 21/second connecting part 22. The connecting component body 203*a* is bent into 90°, the four connecting components 20*a* are successively connected with the four connector bodies 10 to form a square. The connecting component body 203*a* is made of hard rubber, rigid plastic or metal materials.

Embodiment III

Figure 5:
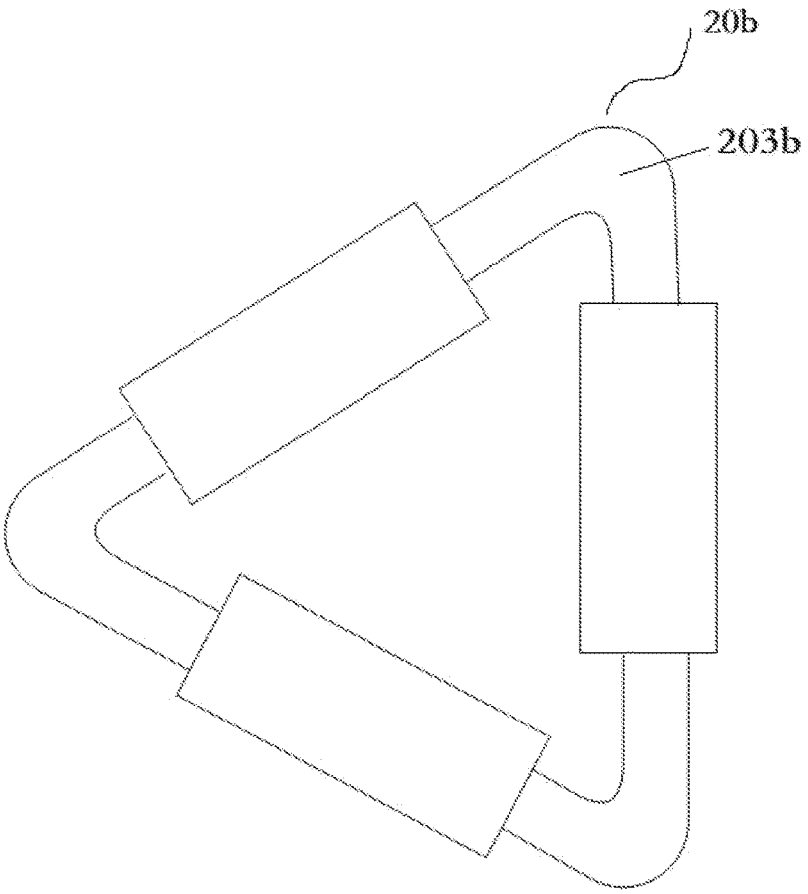
FIG. 5 is a splice structure diagram of the splice connector provided by the embodiment III of the invention.

Please refer to FIG. 5, and FIG. 5 is the second connecting part structure diagram of the splice connector provided by the embodiment III of the invention;

The connector in the embodiment III is the same as the connector basically in the embodiment II, and the major difference lies in that: in the embodiment III, the connecting component body 203*b* is bent into 60°. The three connecting components 20*b* are successively connected with the three connector bodies 10 to form a regular triangle.

Embodiment IV

Figure 6:
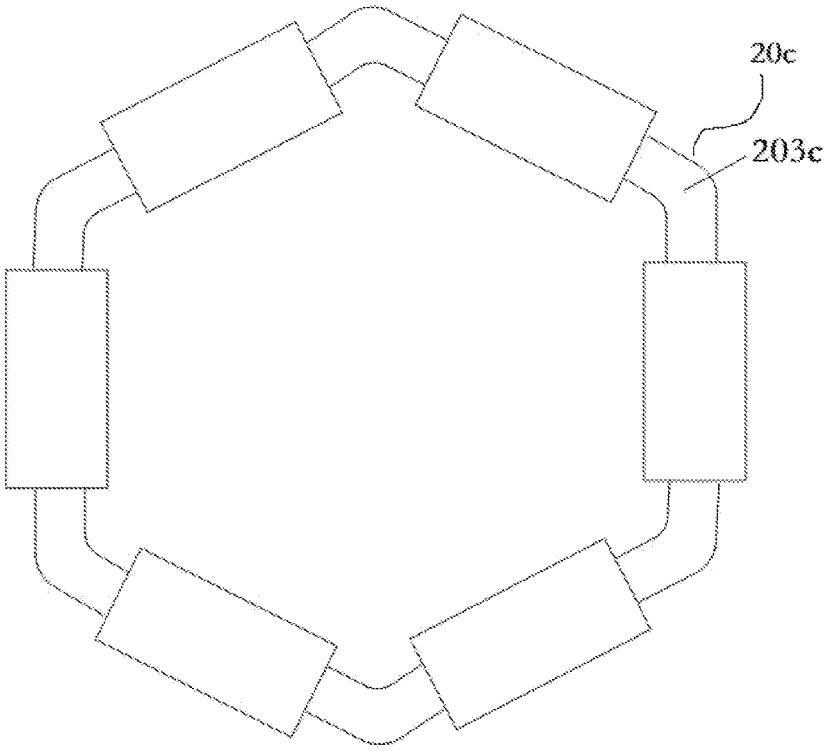
FIG. 6 is a splice structure diagram of the splice connector provided by the embodiment IV of the invention.
Figure 7A:
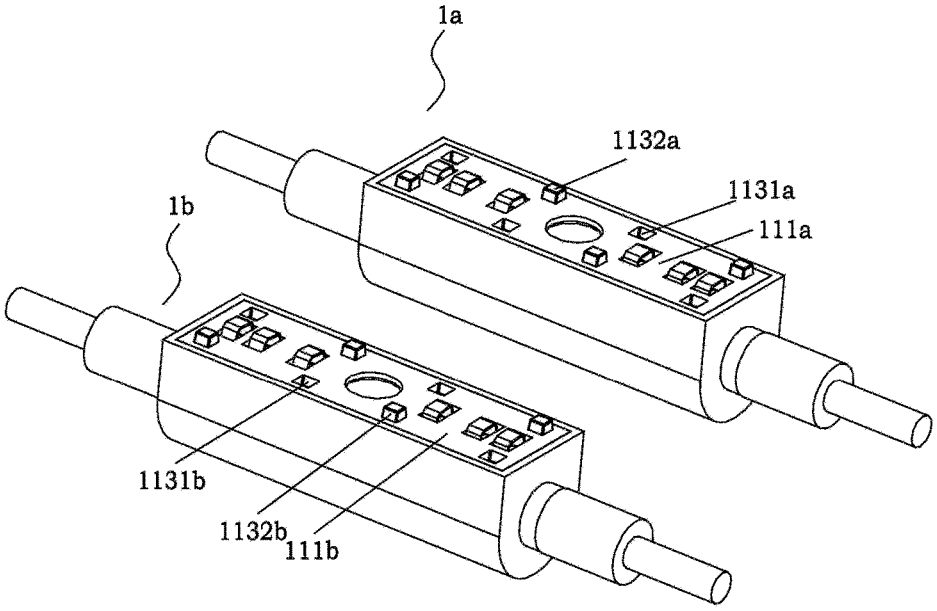
FIG. 7A and 7B illustrate the abutted between two connectors provided by the embodiment I of the invention.
Figure 7B:
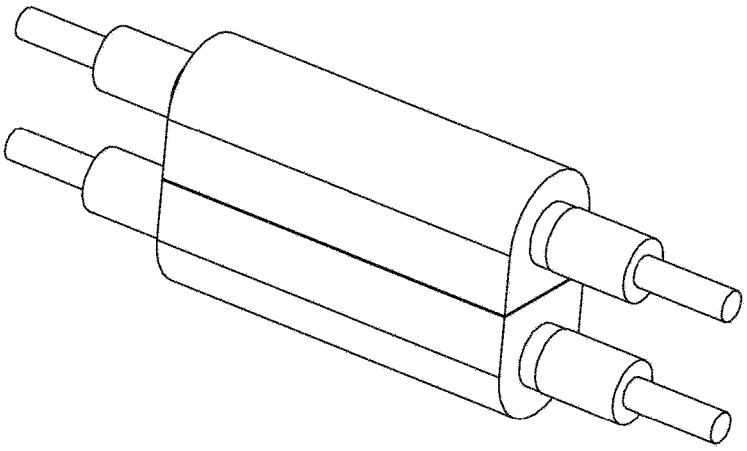

Please refer to FIG. 6, and FIG. 6 is the second connecting part structure diagram of the splice connector provided by the embodiment IV of the invention;

The connector in the embodiment IV is the same as the connector basically in the embodiment II, and the major difference lies in that: in the embodiment IV, the connector body 203*c* is bent into 120°. The six connecting components 20*c* are successively connected with the three connector bodies 10 to form a regular hexagon.

The splice connector provided in the invention is not limited to the above embodiments, and in other embodiments of the invention, the connecting component 20 is the connecting wire, capable of being connected to various electronic equipment. Or, in another embodiment of the invention, the connecting component 20 is made of a bendable flexible material so that the connecting component 20 is capable of being bent into any angle.

Beneficial effects of the invention are as follows: the splice connector 1 provided by the invention comprises a connector body 10 and a connecting component-wire 20 connected with the connector body 10 via by plug joint. The connection of the two same connector bodies 10 can be rapidly implemented via the attraction force of the two magnetic components 12 as well as the coordination between the positioning post 1132 and positioning hole 1131.

Meanwhile, the multiple connector bodies 10 and the connecting component 20 can be spliced into different geometrical shapes, capable of being used as connectors and ornaments via setting the connecting component 20 into different angles and length.

For the technical staff in this field, the invention is not limited to the details of the above demonstrative embodiments obviously, and furthermore, in the premise of not deviating from the spirit or basic features of the invention, the invention can be achieved via other specific forms. Therefore, the embodiment should be regarded as the demonstrative and unrestricted one from any point of view, the scope of the invention is defined by the claims attached instead of the above description. Therefore, the purpose is to include all changes within the meaning and scope of the element equivalent to the claim into the invention. Any reference symbol in the claim should be not treated as the claim involving in the restriction.

In addition, what should be understood is that the specification is described according to the mode of execution, but not each one contains only one independent technical solution, and such kind of description mode of the specification is only for clarification. The technical staff of the field should regard the specification as integrity and properly combine the technical solutions in each embodiment to form other understandable modes of execution.

I claim:

1. A splice connector, comprising a connector body and a connecting component connected to the connector body by plug joint; wherein the connector body comprises a shell, a magnetic component arranged in an inside of the shell and configured for magnetic attraction, and a conductive component embedded on the shell; the shell comprises an abutting surface, two end surfaces vertical to the abutting surface, a positioning component arranged on the abutting surface and for positioning while abutting with other connectors; a first jack and a second jack respectively opened on the two end surfaces; the connecting component is electrically connected to the conductive component via the first jack and the second jack; a connecting hole is opened at the abutting surface on a position right above the magnetic component, and a top portion of the magnetic component is exposed via the connecting hole.

2. The splice connector according to claim 1, wherein the positioning component comprises a positioning hole and a positioning post; the size of the positioning hole corresponds to the positioning post, and the positioning post of the splice connector is embedded into the positioning post of other connectors when the splice connector abutted with the other connectors.

3. The splice connector according to claim 1, wherein the magnetic component is in the shape of spherical or columnar.

4. The splice connector according to claim 1, wherein a LED light source is embedded on an outer surface of the connector; and the LED light source flashes when a current flows through the connector.

5. The splice connector according to claim 1, wherein the connecting component comprises a first end, a second end and a connecting component body; the connecting component is made of a bendable flexible material so that the connecting component is capable of being bent into any angle.

6. The splice connector according to claim 1, wherein the conductive component comprises a first electrode sheet group and a second electrode sheet group, the first electrode sheet group and second electrode sheet group are electrically connected with each other.

7. The splice connector according to claim 6, wherein the first electrode sheet group comprises a first negative electrode sheet, first control electrode sheet and a first positive electrode sheet which are arranged on the connector body in lengthwise direction successively; the second electrode sheet group comprises a second positive electrode sheet, a second control electrode sheet and a second negative electrode sheet which are arranged on the connector body in lengthwise direction successively; the first positive electrode sheet is electrically connected to the second positive electrode sheet; the first negative electrode sheet is electrically connected to the second negative electrode sheet; and the first control electrode sheet is electrically connected to the second control electrode sheet.

8. The splice connector according to claim 6, wherein the connecting component comprises a first connecting part and a second connecting part; the first connecting part is plugged into the first jack, contacting the first electrode sheet group and establishing electrical connection; and the second connecting part is plugged into the second jack, contacting the second electrode sheet group.

9. The splice connector according to claim 6, wherein the first connecting part comprises a first positive electrode component, a first negative electrode component and a first control component; the first positive electrode component contacts the first positive electrode sheet and establishes electrical connection with the first positive electrode sheet; the first negative electrode component contacts the first negative electrode sheet and establishes electrical connection with the first negative electrode sheet; the first control component contacts the first control electrode sheet and establishes electrical connection with the first control electrode sheet; the second connecting part comprises a second positive electrode component, a second negative electrode component and a second control component; the second positive electrode component contacts the second positive electrode sheet and establishes electrical connection with the second positive electrode sheet; the second negative electrode component contacts the second negative electrode sheet and establishes electrical connection with the second negative electrode sheet; and the second control component contacts the second control electrode sheet and establishes electrical connection with the second control electrode sheet.

10. The splice connector according to claim 1, wherein the connecting component comprises a first end, a second end and a connecting component body; the connecting component body is bent into an angle, and the angle is an interior angle of a regular polygon.

11. The splice connector according to claim 10, wherein the angle is 60°, 90° or 120°.

12. The splice connector according to claim 10, wherein the connecting component body is made of hard rubber, rigid plastic or metal materials.

* * * * *